US005193730A

United States Patent [19]

Tanaka et al.

[11] Patent Number: 5,193,730

[45] Date of Patent: Mar. 16, 1993

[54] PNEUMATIC NAILING MACHINE

[75] Inventors: Hiroshi Tanaka; Michiaki Adachi, both of Tokyo, Japan

[73] Assignee: Max Co., Ltd., Tokyo, Japan

[21] Appl. No.: 887,752

[22] Filed: May 27, 1992

[30] Foreign Application Priority Data

Oct. 30, 1991 [JP] Japan ..... 3-53196[U]
Oct. 30, 1991 [JP] Japan ..... 3-113373[U]

[51] Int. Cl.[5] ..... B25C 1/04

[52] U.S. Cl. ..... 227/8; 227/113; 227/116; 227/136

[58] Field of Search ..... 227/8, 113, 114, 116, 227/117, 120, 130, 136

[56] References Cited

U.S. PATENT DOCUMENTS

| | | | |
|---|---|---|---|
| 2,783,468 | 3/1957 | Schwartz | 227/116 |
| 3,623,646 | 11/1971 | Cast et al. | 227/114 |
| 3,764,054 | 10/1973 | Monacelli | 227/114 |
| 4,313,552 | 2/1982 | Maurer | 227/116 |
| 4,463,888 | 8/1984 | Geist et al. | 227/116 |
| 4,570,840 | 2/1986 | Bull | 227/114 |

*Primary Examiner*—Douglas D. Watts

*Assistant Examiner*—Scott A. Smith

*Attorney, Agent, or Firm*—Cushman, Darby & Cushman

[57] ABSTRACT

A nailing machine according to the present invention comprises a nail push member for separating a nail from a nail band supplied to the nail injection hole of the nose member by the nail supply mechanism before the nail is driven by the percussion driver and for pushing the nail to the front of the nail injection hole; and a nail holding means for holding the body part of the nail pushed to the fore side of the nose member by the nail push member in a state that the pointed end of the nail is protruded. Thereby, the nailing machine can easily be positioned in a manner that the pointed end portion of a nail is protruded from the foremost end of the nose member by a predetermined length before the nailing machine drives a nail supplied to the nailing position, and the protruded end of the nail can be inserted into a through-hole of the work. Further, the nailing machine can drive a nail exactly through the through-hole in a manner that the nail protruded from the foremost end of the nose member is inhibited from moving in the direction orthogonal to the nail axial direction, thereby to prevent the nail from being slanted when it is set to the through-hole.

8 Claims, 10 Drawing Sheets

PNEUMATIC NAILING MACHINE

BACKGROUND OF THE INVENTION

1. Field of the Invention

The present invention relates to a pneumatic nailing machine in which a percussion piston slidably contained in a percussion cylinder is driven by impact using compressed air for a power source, and nails successively supplied to a nail injection hole are successively driven into the work to be nailed, with a percussion driver integrally coupled with the bottom surface of the percussion piston. More particularly, the invention relates to a nailing machine which is capable of exactly and easily driving a nail to a through-hole as a nail receiving hole previously formed in the work.

2. Discussion of the Prior Art

Generally, a pneumatically driven nailing machine includes a percussion cylinder, a percussion piston reciprocatively disposed within the percussion cylinder, a nose with a nail injection hole formed in the lower part of the cylinder of a nailing machine body which contains the above components, a percussion driver slidably disposed within the nail injection hole, the driver being integrally coupled with the bottom surface of the percussion piston, and a head valve for connecting the upper part of the inside of the percussion cylinder selectively to a main chamber or the air (the atmosphere). A nail supply opening, which is formed in the side wall of the nose, supplies the nail band into the nail injection hole in successive order. A nail supply mechanism is disposed near the nail supply opening. The mechanism successively supplies connected nails through the opening to the nail injection hole. In the conventional nailing machine, usually, the percussion piston rests at the top dead center of the percussion cylinder. It is moved downward by compressed air, which is introduced into the percussion cylinder by operating a trigger valve to drive a head valve. Nail, for example, which is previously supplied to the nail injection hole, is driven into the work with the percussion driver fixed to the bottom surface of the percussion piston. After the percussion piston moves down to reach the bottom dead center, the percussion piston, while being driven, receives on the bottom surface the compressed air stored in a return air chamber to return to the top dead center. Incidentally, nails are coupled, by a plastic band or wires, into an integral form. This will be called a nail band. The connected nails are successively supplied into the nail injection hole along a nail supply guide formed continuously on one side edge of the nail supply opening. A nail supply mechanism includes a nail supply cylinder disposed along the nail supply guide, a nail supply piston contained in the cylinder, and a nail feed claw member to be in engagement with the body part of the connected nail, the claw member being mounted on the fore end of the piston rod. The nails are automatically fed to the nail injection hole by the nail feed claw member reciprocating in association with the percussion piston.

In the recent field of house building, ceramic material, such as Color Best (trade name), is used for roofing material. If nail is directly driven into the roofing material, it will be broken. To avoid this, through-holes for receiving nails are previously formed in the roofing material. To fix the roofing material to the roof, nail is driven to the roof through the through-hole.

Also in this field, a metal reinforcing fitting element is applied to two members and is fixed to them by nails.

The reinforcing fitting element also has a through-holes for receiving a nail.

In the nailing work for the roofing material and the reinforcing fitting elements, the foremost end of the nose a nailing machine is positioned to the through-hole before the nailing machine is driven. Even if the positioning between the nose and the through hole is exactly done, an operator frequently fails to insert the pointed end of the nail into the through-hole with a smaller diameter than that of the nail injection port since the pointed end of the nail to be nailed is freely movable within the nail injection port of the machine. When the insertion fails, the roofing material is cracked or the nail is bent.

In the nailing work for the members having through-holes for receiving nails, one of the best ways of positioning the nailing machine is to insert the pointed end of the nail into the through-hole directly.

SUMMARY OF THE INVENTION

Accordingly, an object of the present invention is to provide a nailing machine which can easily be positioned in a manner that the pointed end portion of a nail is protruded from the foremost end of the nose member by a predetermined length before the nailing machine drives a nail supplied to the nailing position, and the protruded end of the nail is inserted into a through-hole of the work.

Another object of the present invention is to provide a nailing machine which can drive a nail exactly through the through-hole in a manner that the nail protruded from the foremost end of the nose member is inhibited from moving in the direction orthogonal to the nail axial direction, thereby to prevent the nail from being slanted when it is set to the through-hole.

Yet another object of the present invention is to provide a nailing machine using nails of different lengths which can adjust the protruded length of the nail from the foremost end of the nose member to a fixed value, whereby providing an easy insertion of the pointed end of the nail into the through-hole of the work.

To achieve the above object, the nailing machine of the invention is provided with a nail push piston mechanism to separate a nail from a nail band and to move forwardly so that the pointed end portion of a nail, which is supplied to the nose member forming a nail injection port by a nail supply mechanism, is protruded from the foremost end of the nose member before the nail is driven. A nail holding mechanism is provided at the foremost end of the nose member. The nail holding mechanism is for firmly holding the body part of a nail moved by the piston mechanism with the nose end. With the nail holding mechanism, the pointed end part of the nail protruded from and firmly held with the foremost end of the nose is easily inserted into the through-hole for positioning it.

However, many of conventional nailing machines are provided with a safety device. The conventional nailing machine is provided with a contact member, which is constantly protruded toward the foremost end of the nose, and is movable along the nose when it comes in contact with the work. The nailing machine cannot be started up until the contact member contacts with the work and a trigger lever is manually operated. With use of the safety device, even if an operator mistakenly operates the trigger lever, danger that will possibly occur can be minimized.

The safety device using the contact member constantly protruded toward the foremost end of the nose, is an obstacle to the nailing machine according to the present invention in which the pointed end part of the nail is protruded from the nose.

Accordingly, a further object of the present invention is to provide a nailing machine with a safety device which can easily be positioned with the pointed end of a nail protruded from the foremost end of the nose, and when a trigger lever is operated, responds to the contact of the nail end with the work to start up the nailing machine.

A nailing machine according to the present invention may include: a housing defining the contour of a nailing machine body; a percussion cylinder disposed within the housing; a percussion piston slidably disposed within the percussion cylinder and integrally coupled with a percussion driver for driving nails; a nose member provided at one end of the housing, the nose member having a nail injection hole for slidably guiding the percussion driver; nail supply means, supported by the nose member, for successively supplying connected nails to the nail injection hole through an opening formed in the side wall of the nail injection hole; a main chamber provided within the housing and coupled with an air supply source; a main valve, disposed at the upper end of the percussion cylinder, for introducing compressed air in the main chamber into the percussion cylinder or for discharging compressed air in the percussion cylinder to the air; a trigger valve, manually operable, for supplying to the main valve an operation signal to operate the main valve, wherein the nailing machine comprises nail push means for separating a nail from the connected nails supplied to the nail injection hole of the nose member by the nail supply means before the nail is driven by the percussion driver, and for pushing the nail to the front of the nail injection hole; and nail holding means for holding the body part of the nail pushed to the fore side of the nose member by the nail push means in a state that the pointed end of the nail is protruded.

The nailing machine according to the present invention may be provided with the nail protruding means comprises: a nail push member movable along the axis of the nail injection hole of the nose member, the nail push member advancing to and retracting from the nail injection hole through slits formed in the side wall of the nail injection hole; a piston cylinder mechanism having a piston, which is operable interlocking with the nail push in order to move the nail push member along the nail injection hole of the nose member; wherein the piston cylinder mechanism is normally located at the nail protrusion position, the piston is operated in response to a nail drive instruction of the nailing machine, thereby to retract the nail push member, and after the nail is driven, the piton is operated in the operation direction to cause the nail push member to protrude the nail from the nose member, whereby the nail is held thereat.

The nailing machine according to the present invention may be provided with the nail holding means may includes a pair of chuck mechanism supported at the nose member in a manner that the chuck mechanisms are rotatable in the axial lines orthogonal to the axis of the nail injection hole, whereby in a normal state, the chuck mechanisms nip the body part of the nail protruded from the foremost end of the nail injection hole by the nail protruding means, thereby preventing the nail from dropping out of the nail injection hole.

The nailing machine according to the present invention may be provided with the nail holding means which is arranged such that a lock cylinder is disposed between the operation means of the nail chuck mechanisms, the piston rod of the lock piston contained in the lock cylinder is disposed in opposition to the operation means, a main valve operating signal is supplied from the trigger valve to both the lock pistons of the lock cylinder.

The nailing machine according to the present invention may be provided with a door valve which includes a door supported by the nose member so as to allow connected nails to be loaded into the nail supply mechanism, the door valve being operated when the door is opened, the door valve is disposed in the air path connecting the piston cylinder mechanism to the drive valve, and the air in the air path is controlled so that the piston cylinder mechanism is operated by opening the door, whereby the nail push member is moved to the retracted position, and the nail push member is moved to the nail protrusion position again by closing the door.

The nailing machine according to the present invention may be provided with a nail protrusion length adjusting mechanism which is arranged such that the piston cylinder mechanism of the nail protruding means includes a piston stop member, disposed under the cylinder, for determining the bottom dead center of the piston when it engages the bottom face of the piston, the piston member being held in the cylinder in a manner that the position of the piston member is adjustable in the longitudinal direction along the movement direction of the piston.

The nailing machine according to the present invention may be provided with a safety mechanism including: a trigger lever, manually operable, for operating the trigger valve; a contact member being slidably held by the nose member in a manner that the contact member is slidable along the axis of the nail injection hole of the nose member, the first end of the contact member being disposed in the vicinity of the trigger lever and the second end of the contact member serving as a contact portion to be brought in contact with a member to be nailed; spring means for constantly urging the contact member to be located at the position to which the contact portion retracts; operation member rotatively supported by the trigger lever, cooperating with the upper end of the contact member to allow the trigger lever, when operated, to operate the trigger valve when the contact member is not operated; and a spring member carried on the trigger lever, engaging the first end of the contact member when the trigger lever is turned, whereby moving the contact member in the protrusion direction.

The safety device of the nailing machine according to the present invention may further include a swing lever to be brought in engagement with the operation member, the swing lever is located on the upper part of the contact member, the locus of the foremost end of the operation member, when the trigger lever is turned, is depicted such that it is swung up to the position where it departs from the swing lever, and the swing lever is supported in a manner that it is rotative in the retraction direction so as not to interrupt the turn of the operation member in the return direction, and further is resiliently urged.

BRIEF DESCRIPTION OF THE DRAWINGS

FIG. 12 is a sectional view showing a state of the safety device when it is not operated;

FIG. 13 is a sectional view showing a state of the safety device when the nose of the machine is located on the work and a trigger lever thereof is operated;

FIG. 14 is a sectional view showing a state of the safety device when the trigger lever is operated in a state that the work is not placed in the fore side of the nose; and FIG. 15 is a sectional view showing a state of the safety device when the nose is brought into contact with the work from the state of FIG. 14, and then the trigger lever is operated again.

DETAILED DESCRIPTION OF THE PREFERRED EMBODIMENT

Figure 1:
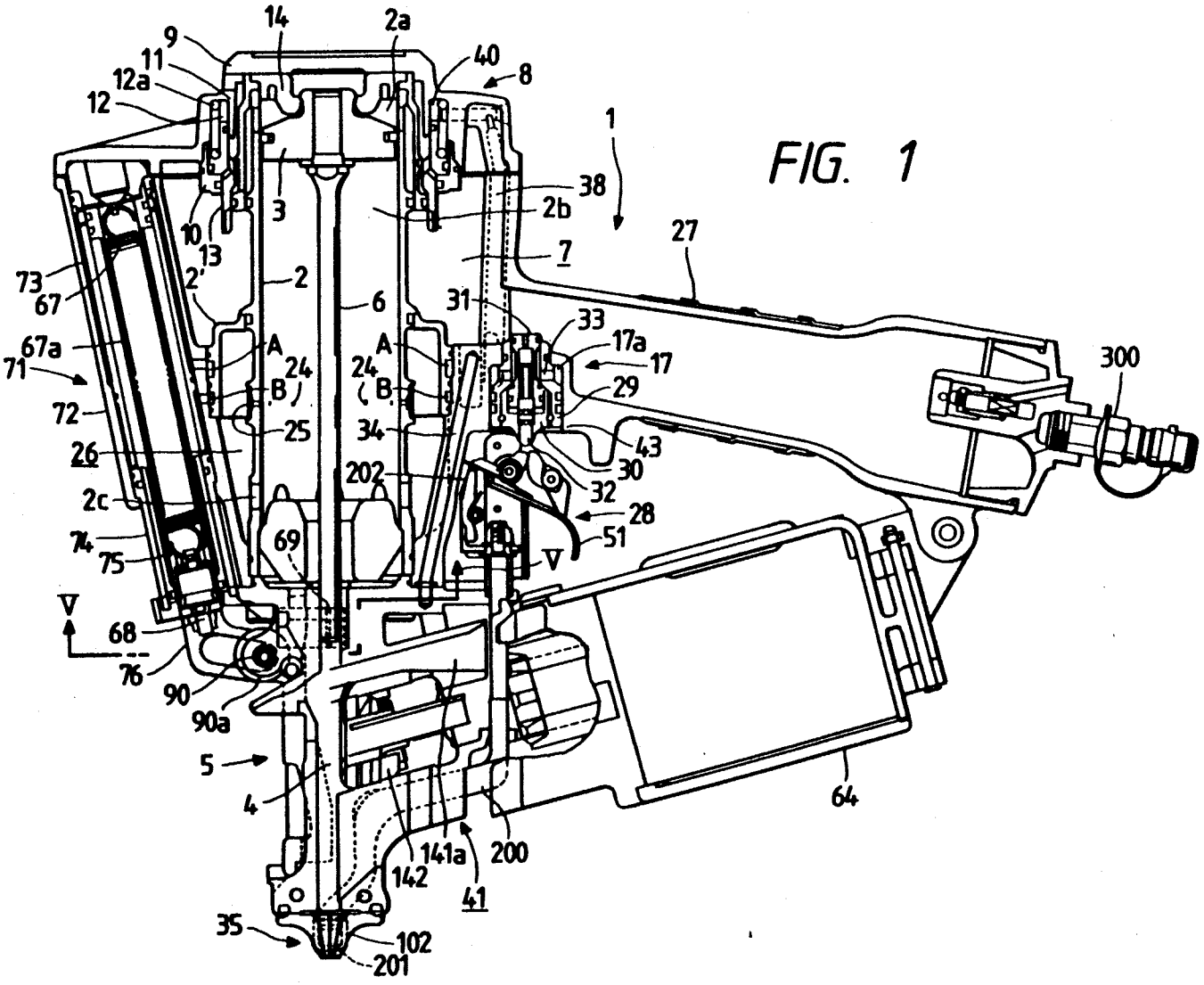
FIG. 1 is a longitudinal sectional view showing a nailing machine which is one of the preferred embodiments of the present invention.

An embodiment of a pneumatic nailing machine according to the present invention, which is believed to be preferred, will be described in details with reference to the accompanying drawings. FIG. 1 is a longitudinal sectional view showing a key portion of a pneumatic nailing machine with a nail holder according to the present invention. In the illustration, a percussion piston is at a standstill at the top dead center.

As shown in FIG. 1, a percussion cylinder 2 is disposed within a nailing machine body 1. A percussion piston 3 is reciprocatively disposed within the percussion cylinder 2. A nose 5, provided in the lower part of the machine body 1, protrudes from one or first end of the percussion cylinder 2, coaxially with the percussion cylinder 2. The nose 5 is provided with a nail injection hole 4 extending coaxially with the percussion cylinder 2. A nail driver 6 as a piston rod to drive a nail is connected to the bottom side of the percussion piston 3 in an integral form. The nail driver 6 reciprocates within the nail injection hole 4 of the nose 5.

Compressed air for reciprocating the percussion piston 3 within the percussion cylinder 2 is supplied from a main air chamber 7 located within the machine body 1, more exactly around the cylinder 2 and inside a grip 27. The main air chamber 7 is supplied with compressed air from a compressed air source (not shown) located outside the machine. To this end, the main air chamber 7 communicates with the compressed air source through an air plug 300 provided at the tail end of the grip 27.

Figure 3:
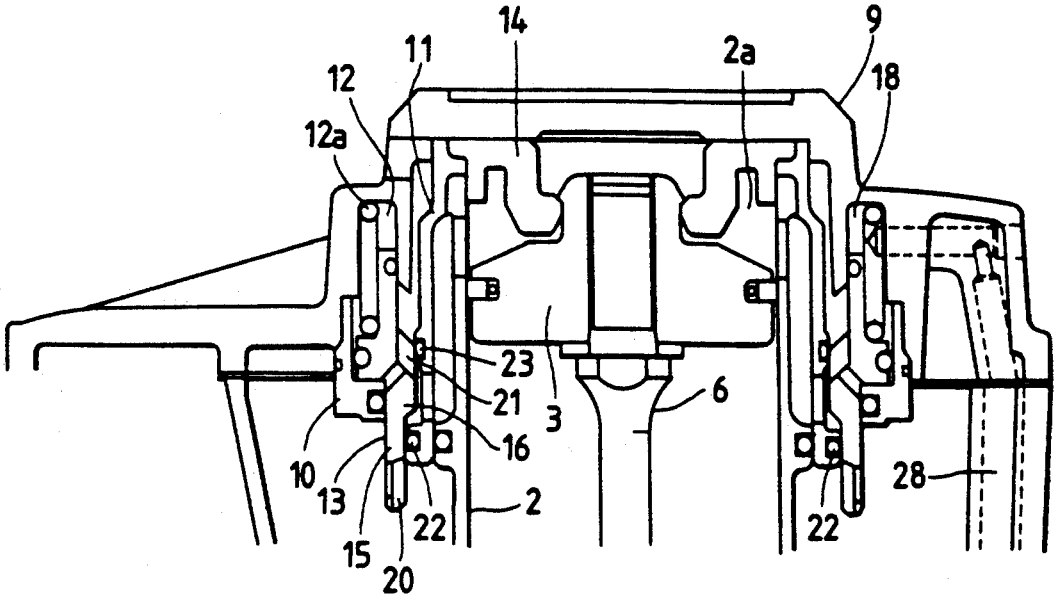
FIG. 3 is an enlarge sectional view showing a main valve portion in FIG. 1.

As shown in FIGS. 1 and 3, a head valve 8 includes a sleeve-like, inner cylinder element 10, a ring-like outer cylinder element 11, a head valve body 13, and a valve spring 12*a*. The inner cylinder element 10 is disposed around the upper end portion of the percussion cylinder 2 while being spaced from the cylinder. The outer cylinder element 11 is suspended from the inner face of a cap 9. The head valve body 13, disposed within a bore 12 located between the inner and outer cylinder elements 10 and 11, is reciprocatory in the axial direction of the percussion cylinder. The valve spring 12*a* engages the top end of the head valve body 13 disposed within the bore 12 to urge the head valve body 13 downwardly.

A piston stop 14 made of resilient material is fastened to the inner face of the cap 9 of the machine body 1 at the place thereon corresponding to the top end of the percussion cylinder 2. The piston stop 14 holds the piston 3 so as not to rebound the piston 3 when the piston 3 returns to the top dead center.

The head valve body 13 is provided with a main valve 15 for opening and closing a path communicatively connecting the main air chamber 7 to a piston upper chamber 2*a*. In the mid portion of the head valve body 13, a ring-like exhaust valve 16 is disposed within the valve body 13. The valve 16 is provided for opening and closing a path originating from the upper chamber 2*a* to exterior. A ring-like control portion 18, located outside the upper portion of the head valve body, receives a nailing-start air pressure signal and a nailing-end air pressure signal from the trigger valve 17. A plurality of slits 20 are extended from the lower end of the main valve 15 while being circumferentially arrayed. A plurality of slits 21 are extended from the top end of the exhaust valve 16 while being circumferentially arranged.

When the head valve body 13 is located at the bottom dead center, the inner wall of the main valve 15 is in contact with an O-ring 22 above the array of slits 20. The O-ring 22 is fitted in the outer surface of the lower end portion of the inner cylinder element 10. Under this condition, the path between the main air chamber 7 and the upper chamber 2*a* is closed. In the level of the slits 21, the exhaust valve 16 is in contact with an O-ring 23 fitted on the outer surface of the inner cylinder element 10, whereby to open the upper chamber 2*a* to air.

When the head valve body 13 is located at the top dead center, the inner wall of the main valve 15 is brought in contact with the O-ring 22 in the level of the slits 20, whereby to open the path between the main air chamber 7 and the upper chamber 2*a*. The exhaust valve 16 comes in contact with the O-ring 23 in the level below the slits 21, whereby to close the upper chamber 2*a* to isolate it from the air (atmosphere).

Figure 4:
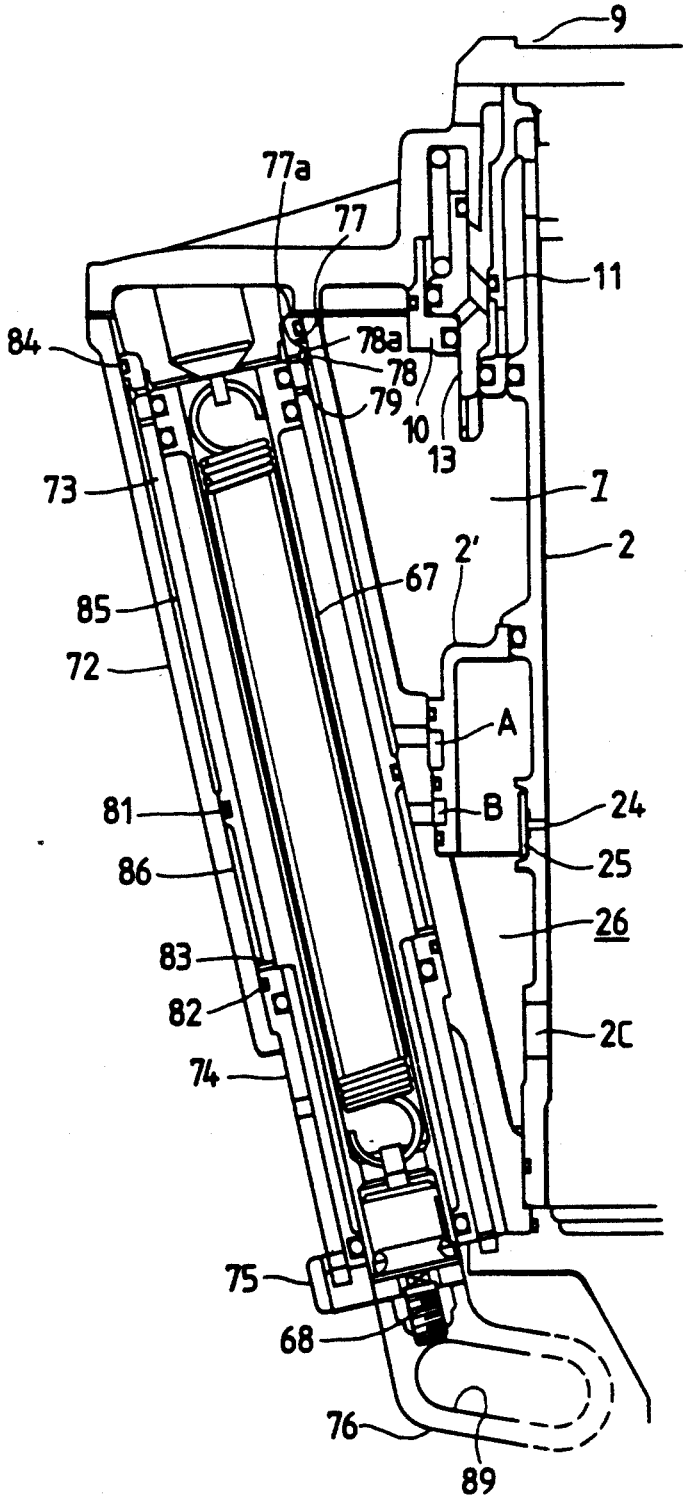
FIG. 4 is an enlarge sectional view showing a portion of a nail push mechanism.

As shown in FIGS. 1 and 4, the peripheral wall of the percussion piston 3 has a number of perforations 24 in the level near the middle height as axially viewed, the holes being circumferentially arranged. These perforations 24 communicate, through a check valve 25, with a return air chamber 26. The check valve 25, e.g., a rubber band, is installed on the outer surface of the peripheral wall of the percussion piston 3. The return air chamber 26 is formed outside the lower part of the percussion piston 3. A through-hole 2c is formed in the further lower part of the peripheral wall of the percussion piston 3. The through-hole 2c communicatively connects the return air chamber 26 with a percussion piston lower chamber 2b at all times.

As shown in FIG. 1, the trigger valve 17 for generating a nailing-start air pressure signal and a nailing-end air pressure signal is provided in the base of the grip 27 of the machine body 1. A trigger 28 is installed on the outer surface of the lower part of the machine body 1 in a manner that it confronts with the trigger valve 17.

Figure 7B:
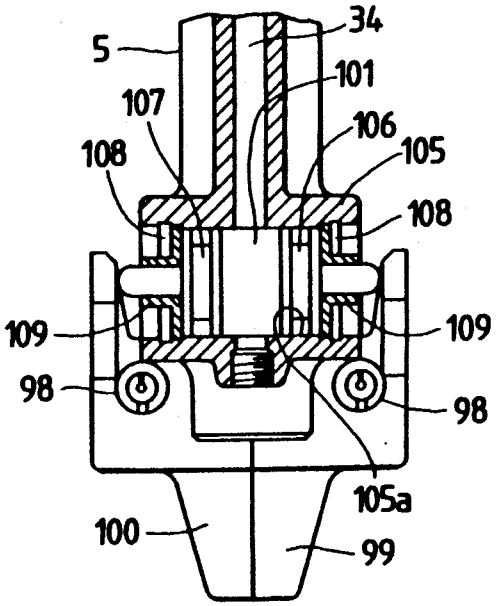
FIG. 7 shows cross sectional views showing operating states of a nail holding mechanism, in which (a) shows a state of the mechanism when it is not operated, and (b), a state of the mechanism when it is operated.
Figure 7A:
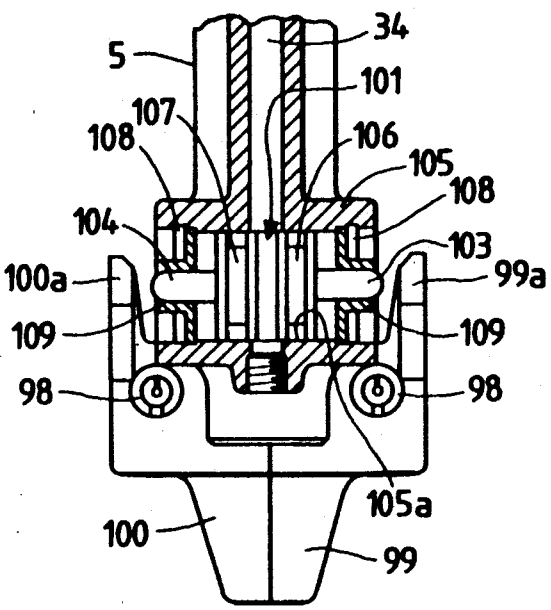

The trigger valve 17 includes a cap 30, a substantially tubular, trigger valve piston 31, and a trigger valve stem 32. The cap 30 is inserted into a lower end opening of a substantially tubular, trigger valve housing 29, which is inserted into a hole 27a formed in the base of the grip 27 and fixed therein. The trigger valve piston 31 is slidably disposed in a chamber defined by the trigger valve housing 29 and the cap 30. A major part of the trigger valve stem 32 is disposed in a chamber defined by the cap 30 and the trigger valve piston 31, while the lower end of the stem projects toward the trigger 28. A plurality of through-holes 33 are formed in the peripheral wall of the trigger valve housing 29 in the level near the middle height of the housing. The through-holes 33 communicates with an air path 34 passing through the lower part of the machine body 1 and the nose 5. The air path 34 extends to open into the inside of a lock cylinder 105 of a nail-holder-lock piston cylinder mechanism 101 of a nail chuck 35, as shown in FIGS. 1, 7(*a*) and 7(*b*).

The through-holes 33 further connect to an air path 38, which connects to a control chamber 40 formed within a head valve cylinder element 10 in the head valve 8.

Figure 12:
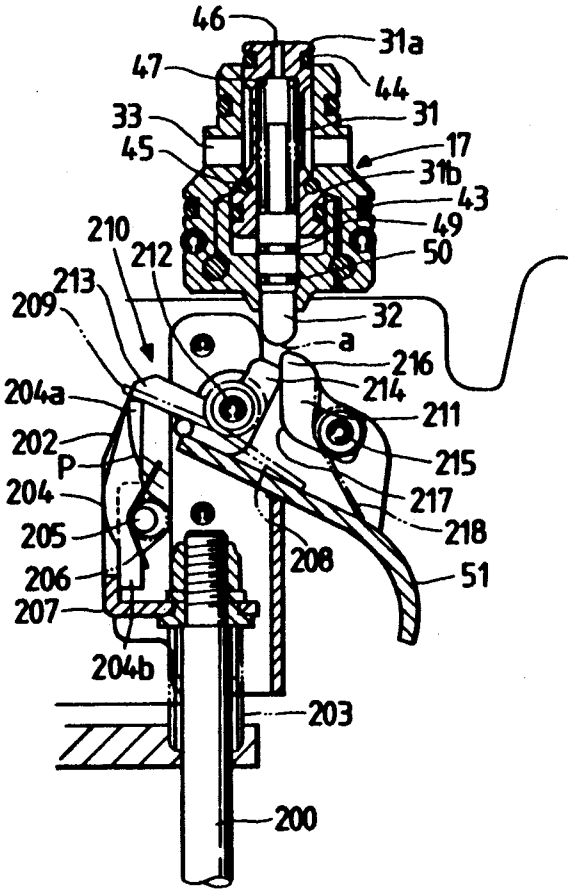

As shown in FIGS. 1 and 12, an exhaust path 43 constantly opened to the air (the atmosphere) is provided between the cap 30 and the trigger valve housing 29. The trigger valve piston 31 includes a feed valve 31a and an exhaust valve 31b, which are located respectively above and under the through-holes 33. The feed valve 31a has an O-ring 44 which functions to open and close the path between the main air chamber 7 and the trigger valve housing 29. The exhaust valve 31b has an O-ring 45 to open and close the path between the inside (i.e., through-holes 33) of the trigger valve housing 29 and the exhaust path 43. When the trigger valve piston 31 stands still at the top dead center, the O-ring 44 is apart from the holed wall of the trigger valve housing 29, to allow the main air chamber 7 to communicate with the through-holes 33. At this time, the O-ring 45 is in close contact with the holed wall surface of the trigger valve housing 29 to close the path between the through-holes 33 and the exhaust path 43. When the trigger valve piston 31 stands still at the bottom dead center, the O-ring 44 closes the path between the main air chamber 7 and the through-holes 33. At this time, the O-ring 45 is apart from the holed wall of the trigger valve housing 29, so that the through-holes 33 are opened into the air (the atmosphere) through the exhaust path 43.

A through-hole 46, formed in the central part of the feed valve 31a, communicatively connects the main air chamber 7 to the inside of the trigger valve piston 31. A return spring 47 urging the trigger valve stem 32 toward the trigger 28 is disposed within the trigger valve piston 31.

In the trigger valve stem 32, O-rings 49 and 50 are fitted around the portion of the trigger valve stem 32 where it slides on the wall surface of a hole 48 formed in the cap 30. When the trigger valve stem 32 rests the bottom dead center as shown in FIG. 1, the O-rings 49 and 50 are pressed against the wall surface of the hole 48 to close the gap (not shown) between the trigger valve stem 32 and the cap 30. When it is lifted, in the space expanding between the inside of the trigger valve piston 31 and the air (the atmosphere), up to the top dead center upon the action of a trigger lever 51 of the trigger 28, the O-rings 49 and 50 departs from the wall surface of the hole 48 to open the gap between the trigger valve stem 32 and the cap 30. As a result, the inside of the trigger valve piston 31 is opened to the air (the atmosphere).

In a state that the main air chamber 7 in the machine body 1 is connected to the compressed air source, the compressed air in the main air chamber 7 is supplied through a through-hole 46 to the chamber in the cap 30 formed in the lower part of the trigger valve piston 31. With the compressed air within the chamber, the trigger valve piston 31 is moved to and stopped at the top dead center.

Nail Injection Unit

Figure 8:
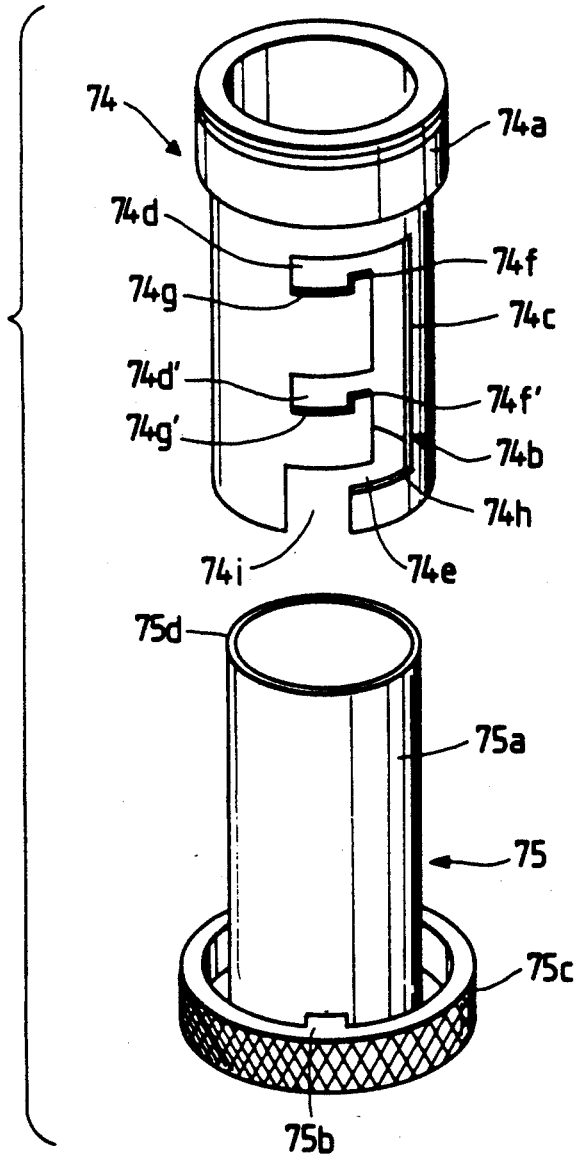
FIG. 8 is a perspective view showing major components of an adjustor mechanism of the nail push mechanism.
Figure 9:
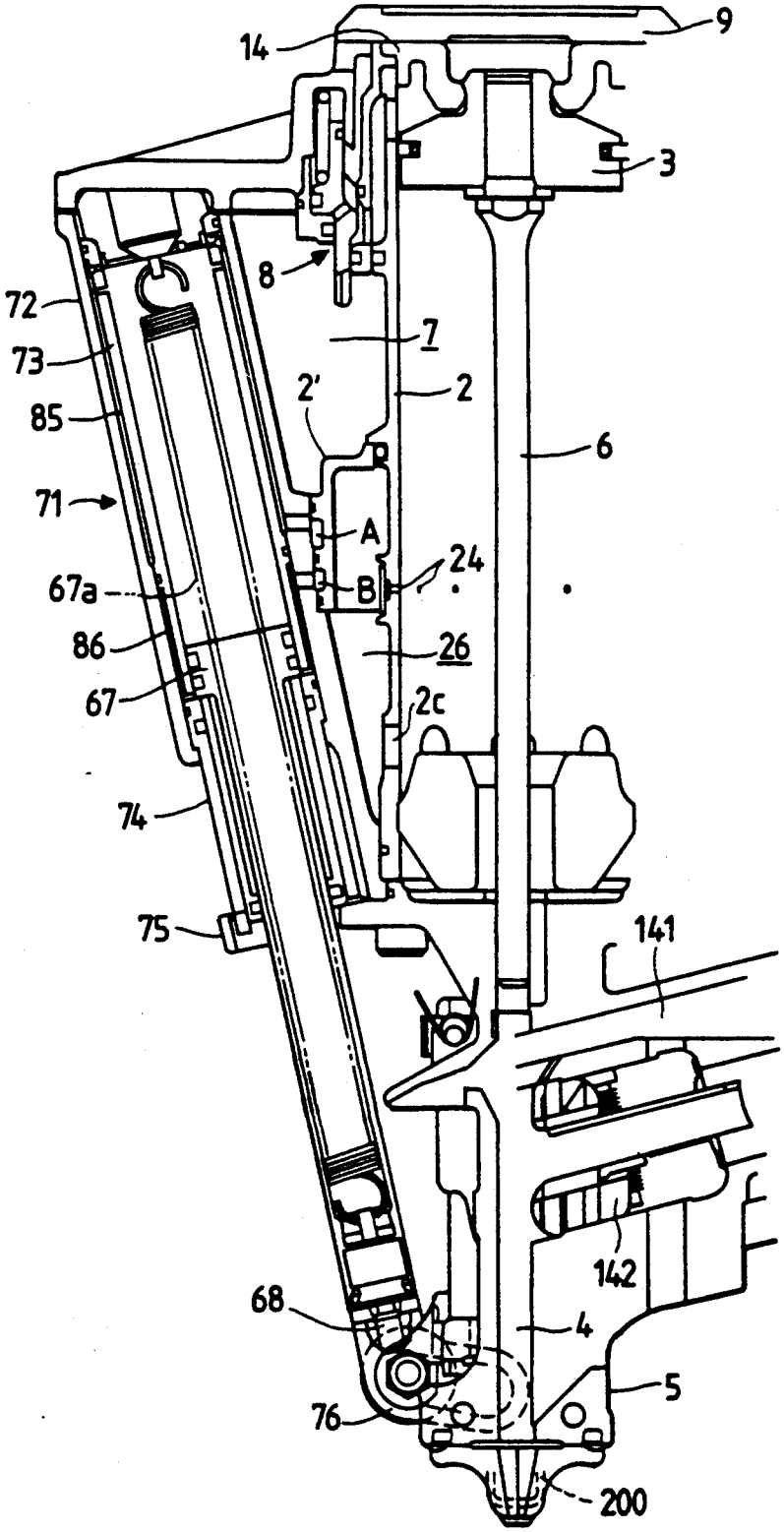
FIG. 9 is a cross sectional view showing a state of operation of the nail push mechanism.

As shown in FIGS. 1, 4 and 9, a nail injection unit 71 is made up of a tubular housing 72, a nail push cylinder 73, a tubular adjust guide 74, a nail-protrusion-quantity adjustor 75, a nail push piston 67, a piston rod 68, a connector 76, a nail pusher 69, and the nail chuck 35. The housing 72, provided in front of the machine body 1, is slanted with respect to the axis of the percussion cylinder 2. The nail push cylinder 73, fixed within the housing 72, is fitted into the housing 72. The adjust guide 74 is protruded from the lower part of the nail push cylinder 73 toward the nose 5. The nail-protrusion-quantity adjustor 75, which is installed within the adjust guide 74, is axially and circumferentially movable relative to the adjust guide 74, as shown in FIG. 8. The adjustor adjusts a nail protrusion from the nail chuck 35 so as to provide a fixed quantity of nail protrusion for any type of nail. The adjustment is done so that the nail injection unit 71 may handle with a nail band consisting of at least two nails of different lengths. The nail push piston 67 is disposed within the nail push cylinder 73. The piston rod 68 is integrally coupled with the nail push piston 67. The connector 76 couples the lower end of the piston rod 68 with the nail pusher 69. The nail pusher 69 is assembled to the nose 5 in a state that it is movable in the axial direction of the nose 5. The nail pusher advances to and retracts from the nail injection hole 4 of the nose 5. The nail chuck 35 is provided at the foremost end of the nose 5.

A ring-like flange 84 outwardly directed is formed around the outer side of the top end portion of the nail push cylinder 73. The flange 84 is brought into contact with the inner wall of the housing 72 in a hermetic manner. An upper air path 85 shaped like a ring is provided between the outer side of the nail push cylinder 73 and the inner side of the housing 72.

Through-holes 77, 78, and 79 are provided in the vicinity of the top end of the cylindrical wall of the nail push cylinder 73. These through-holes communicatively connect the inside of the cylinder 73 with the air path 85. The through-holes 77 and 78 are connected to the upper chamber of the nail push piston 67 within the percussion piston 3. The through-hole 79 is located between two O-rings, which are applied onto the outer side of the nail push piston 67 positioned at the top dead center. A ring-like rubber band 78*a*, which is applied to the outer side of the through-hole 78, functions as a check valve permitting only the flow of compressed air from the inside of the nail push cylinder 73 through the through-hole 78 to exterior. The through-hole 77 is provided with a small path 77*a*, which restricts the flow of the compressed air passing through the through-hole 77. A cylindrical flange 81 outwardly protruded/-directed is formed on the nail push cylinder 73 in the level slightly below the middle height of the nail push cylinder 73. The cylindrical flange 81 is brought into contact with the inner wall of the housing 72 in a hermetic manner. Another cylindrical flange 82 outwardly directed is formed on the lower end portion of the nail push cylinder 73. The cylindrical flange 82 is brought into contact with the inner wall of the housing 72. A plurality of grooves 83, located above the cylindrical flange 82, radially passes through the circumferential wall of the nail push cylinder 73. As seen from the foregoing description, within the housing 72, a ring-like air path 85 encloses the upper part of the nail push cylinder 73, which is located between the outward flanges 84 and 81. The air path 85 is connected to the air path 38, through a door valve 65 to be explained later, and a ring-like air path A formed in a ring-like sleeve 2' formed on the outer side of the percussion cylinder 2. A ring-like air path 85 surrounds the lower part of the nail push cylinder 73 between the outward flanges 81 and 82. A lower air path 85, shaped like a ring, surrounds the lower portion of the nail push cylinder. The air path 86 is connected through a ring-like air path B to the main air chamber 7.

As shown in FIGS. 1 and 4, when the nail push piston 67 and the piston rod 68 move between the top dead center and the bottom dead center, the lower end departs from or approaches to the nose 5. It is necessary to compensate for the departing and approaching movements of the lower end of the piston rod 68, which is slanted with respect to the axis of the percussion cylinder 2. To this end, a screw bolt 90 is fitted through a collar 90*a* into a hole 89 elongated in the direction substantially orthogonal to the axis of the percussion cylinder 2.

Figure 5:
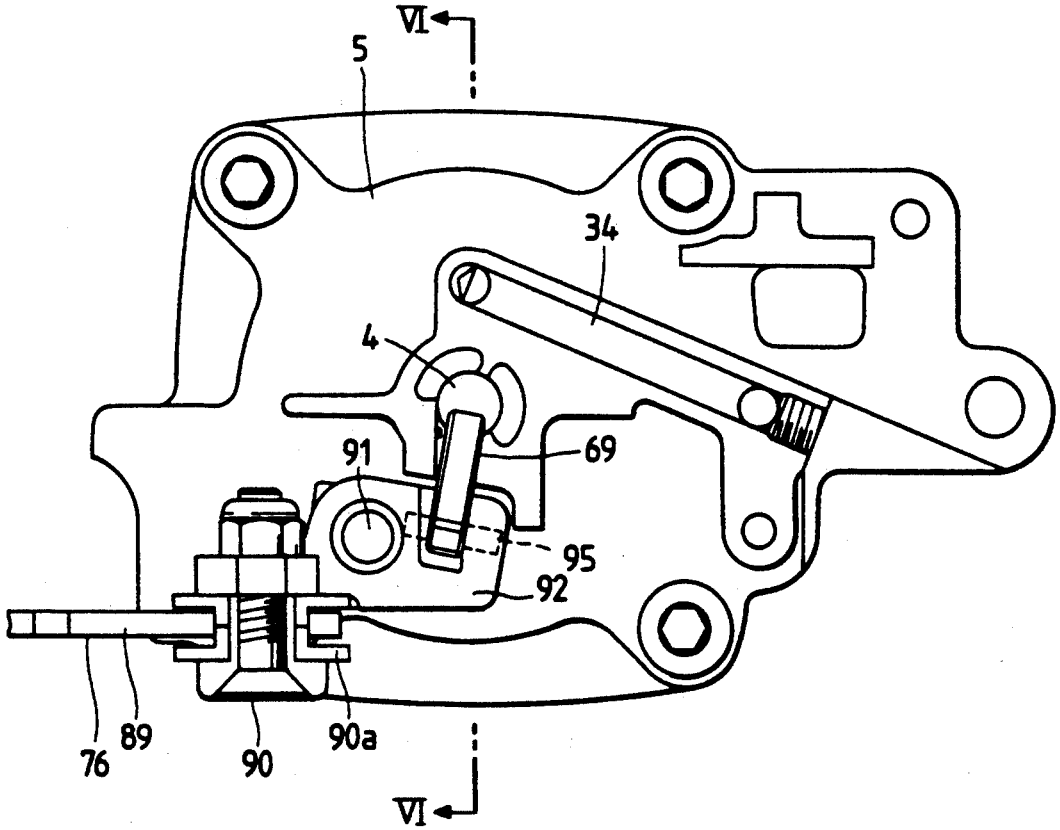
FIG. 5 is a sectional view taken on line V—V in FIG. 1.

As shown in FIG. 5, the screw bolt 90 is fixed to a slider 92, which is slidably supported by a guide rod 91, which is fixedly disposed in parallel with the axial line of the nail injection hole 4 and is passed through the nose 5.

Figure 6:
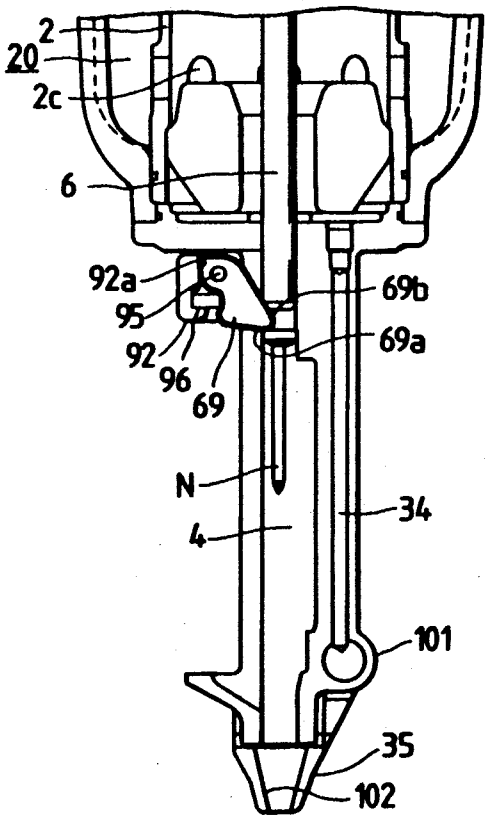
FIG. 6 is a sectional view taken on line VI—VI in FIG. 5.

As shown in FIGS. 5 and 6, the lever-like nail pusher 69 pusher 69 is pivotally supported by means of a pivot 95 on the slider 92. The end face of the free end of the nail pusher 69 forms a contact face 69*a* to be in contact with the enlarged end of a nail. A stop-contact face 69*b* is formed on the pivotal end of the nail pusher 69. The stop-contact face 69*b* functions to engage the nail pusher stop 92*a* of the slider 92 to posture the nail pusher 69 so that the contact face 69*a* exactly is laid on the enlarged end of a nail within the nail injection hole 4 of the nose 5. The nail pusher 69 is always urged counterclockwise (in the direction in which the nail pusher 69 advances to the nail injection hole 4) by means of a coiled spring 96.

A slope face 69*b* is formed above the contact face 69*a* of the nail pusher 69. The nail driver 6 comes in contact with the stop-contact face 69*b* during the course of its percussion process. Specifically, when the nail driver 6 is driven to strike the enlarged end of a nail, the stop-contact face 69*b* engages the end of the nail driver 6, the nail pusher 69 is turned clockwise about the pivot 95, and the contact face 69*a* retracts from the nail injection hole 4.

Adjustor Mechanism

As shown in FIG. 8, an outward flange 74*a*, provided in the upper part of the adjust guide 74, is to be in contact with an inward flange 72*a* provided at the lower end of the housing 72. An opening 74*b*, shaped like U, is formed in the circumferential wall of the adjust guide 74. The opening 74*b* includes a guide part 74*c* extending in the axis of the adjust guide 74, a long-nail engaging part 74*d* continuous to the top of the guide part 74*c* and extending in the circumferential direction of the adjust guide 74, a middle-nail engaging part 74*d'* continuous to the middle portion of the guide part 74*c'* and extending in the circumferential direction of the adjust guide 74, and a short-nail engaging part 74*e*, which is continuous to the bottom of the guide part 74*c*, and extends in parallel with the middle-nail engaging part 74*d'* and the long-nail engaging part 74*d* but is shifted from the long-nail engaging part 74*d* in the circumferential direction. A rectangular adjustor stop 74*f* protruded from the level of the lower side face 74*g* of the long-nail engaging part is formed at the corner of a configuration defined by the lower side face 74*g* and the guide part 74*c*. A rectangular adjustor stop 74*f'* protruded from the level of the lower side face 74*g'* of the middle-nail engaging part is formed at the corner of a configuration defined by the lower side face 74*g'* and the guide part 74*c'*. The short-nail engaging part 74*e* includes its lower side face 74*h*, and is continuous to a guide opening 74*i*, which is elongated in the axial direction of the adjust guide 74 and extended up to the bottom of the adjust guide 74.

The nail-protrusion-quantity adjustor 75 is made up of a cylindrical, nail-piston push stop 75*a*, an engaging part 75*b* located at the lower side of the nail-piston push stop 75*a* and protruded in the radial direction of the nail-piston push stop 75*a*, and a ring-like handle 75*c* coupled with the nail-piston push stop 75*a* by means of the engaging part 75*b*. The outer surface of the handle 75*c* is knurled.

As seen from FIG. 8, when the pneumatic nailing machine uses short nails, the engaging part 75*b* of the nail-protrusion-quantity adjustor 75 engages the lower side face 74*h* of the short-nail engaging part 74*e* of the adjust guide 74. When it uses middle-length nails, the engaging part 75*b'* of the nail-protrusion-quantity adjustor 75 engages the lower side face 74*g'* of the long-nail engaging part 74*d'*. Further, when it uses long nails, the engaging part 75*b* of the nail-protrusion-quantity adjustor 75 engages the lower side face 74*g* of the long-nail engaging part 74*d*.

In the illustration of FIG. 1, the pneumatic nailing machine uses short nails, and the engaging part 75*b* of the nail-protrusion-quantity adjustor 75 engages the lower side face 74*h* of the short-nail engaging part 74*e*. The upper side face 75*d* of the nail-piston push stop 75*a* of the nail-protrusion-quantity adjustor 75 is placed at the low position. When the pneumatic nailing machine uses middle length nails, the upper side face 75*d* of the nail-piston push stop 75*a* is placed at the middle position, although not shown in FIGS. 1 and 9. Further, when the pneumatic nailing machine uses long nails, the upper side face 75*d* of the nail-piston push stop 75*a* is placed at the high position, although not shown in FIGS. 1 and 9.

Nail Holder

Figure 2:
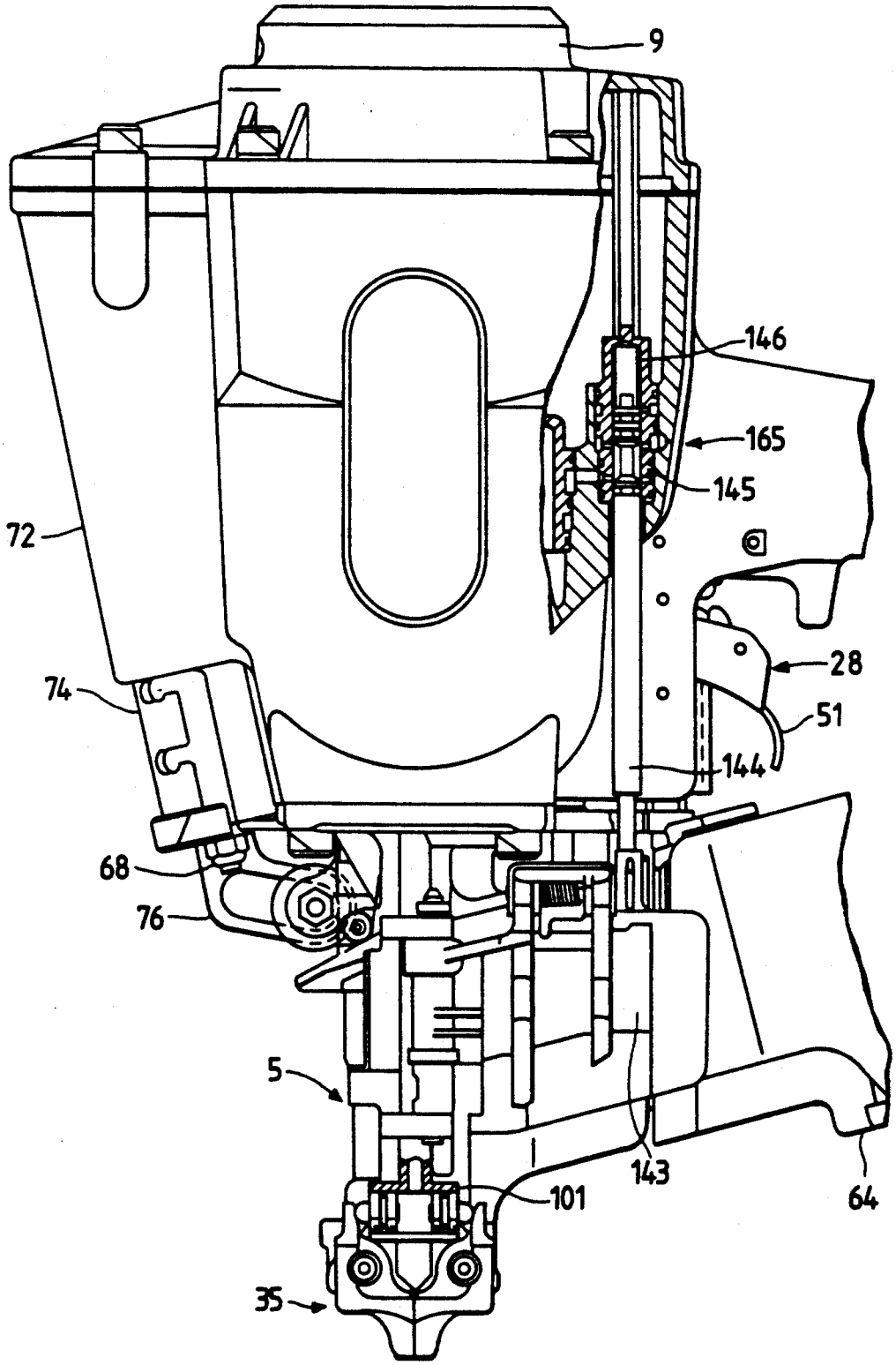
FIG. 2 is a partially broken, side view showing the side of the nailing machine of FIG. 1, which is different from that of FIG. 1.

As shown in FIGS. 2 and 7(*a*), the nail chuck 35 includes a pair of nail holders 99 and 100 and the nail-holder-lock piston cylinder mechanism 101. The nail holders 99 and 100 may be swung about a pair of pivotal pins 98, which are provided at the front and rear of the foremost end part of the nose 5. The piston cylinder mechanism 101 locks the nail holders 99 and 100 in a state that the nail holders 99 and 100, and the nail pusher 69 cooperate to hold a nail in the axial direction of the nose 5. The paired nail holders 99 and 100, when closed, form a taper hole 102 continuous to the nail injection hole 4. The tapered wall of the taper hole 102 is brought into contact with the side surface of the nail body part. Lock operation terminals 99*a* and 100*a*, provided at the upper ends of the nail holders 99 and 100, engage with and disengage from piston rods 103 and 104 of the piston cylinder mechanism 101.

As shown in FIGS. 7(*a*) and 7(*b*), the piston cylinder mechanism 101 is made up of the lock cylinder 105, paired lock pistons 106 and 107, the piston rods 103 and 104, and paired cylinder caps 109. The lock cylinder 105 has a bore 105*a* extended orthogonal to the axis of the nose 5 and integral with the nose 5. The paired lock pistons 106 and 107 are installed within the lock cylinder 105. The piston rods 103 and 104 are respectively protruded from the paired lock pistons 106 and 107 toward the lock operation terminals 99*a* and 100*a*. The paired cylinder caps 109 are fixed by a step of the lock cylinder 105 and a snap ring 108.

The paired lock pistons 106 and 107 are respectively provided with O-rings, not shown. The paired cylinder caps 109 include cylindrical slide guides for guiding the movement of the piston rods 103 and 104.

The air path 34 opens into the inside of the lock cylinder 105 at the middle position of the lock cylinder 105 as viewed longitudinally. Air pressure within the air path 34 acts on the rear side of the front piston 106 and the front side of the rear piston 107. As shown in FIG. 7(*b*), when the compressed air is supplied to the air path 34, the paired lock pistons 106 and 107 advance to a position where these come in contact with the front and rear cylinder caps 109, and the ends of the piston rods 103 and 104 are respectively pressed against the lock operation terminals 99*a* and 100*a* of the nail holders 99 and 100. Accordingly, the nail holders 99 and 100 cooperate with the nail pusher 69 to be in contact with the enlarged end of a nail, to fixedly hold a nail in a manner that the wall surface of the taper hole 102 is pressed against the body part of the nail, and the nail is postured coaxially with the nail injection hole 4.

Operation

Figure 10:
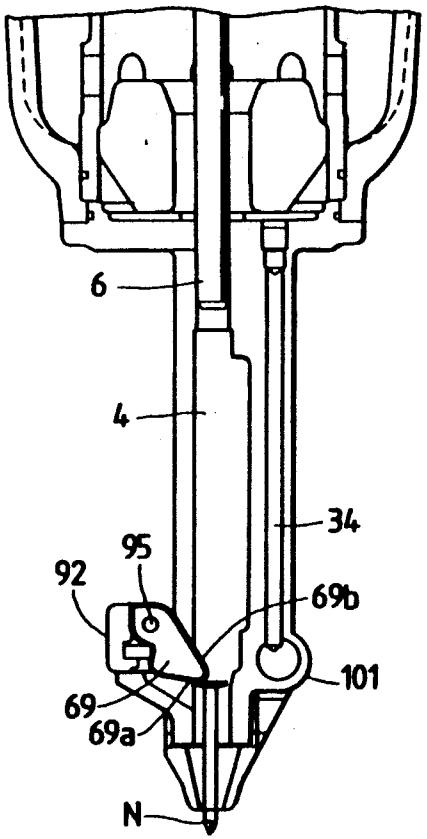
FIG. 10 is a sectional view, like that of FIG. 6, showing a state of the machine when a nail pusher is moved to the nail push position.

The operations of the nail injection mechanism and the nail chuck mechanism will be described. A nail band is set between a magazine 64 and the nail injection hole 4 of the nose 5. The main air chamber 7 within the machine body 1 is connected to a compressed air source. Before nail-drive work, the trigger valve stem 32 of the trigger valve 17 is at the bottom dead center and the trigger valve piston 31 is positioned at the top dead center, with the compressed air guided into the cap 30. Under this condition, the compressed air in the main air chamber 7 is supplied to the air paths 34 and 38. Within the nail injection hole 4, a nail is separated from the nail band with the movement of the nail push piston 67 to the bottom dead center. The separated nail is held coaxially with the nail injection hole 4 by the nail pusher 69 and the nail chuck 35. The nail holders 99 and 100 of the nail chuck 35 are locked with the piston cylinder mechanism 101 (FIGS. 9 and 10).

In this state, the trigger lever 51 is pulled, the trigger valve stem 32 moves from the bottom dead center to the top dead center, and the compressed air in the air paths 34 and 38 are discharged to the air (the atmosphere) through the exhaust path 43 of the trigger valve 17. Accordingly, the paired lock pistons 106 and 107 of the piston cylinder mechanism 101 are released from being locked. The compressed air within the nail-push piston upper chamber within the nail push cylinder 73 is also discharged to the air (the atmosphere). The nail push piston 67 returns from the bottom dead center to the top dead center. At the same time, the compressed air within the control chamber 40 of the head valve 8 is discharged to the air (the atmosphere) through the air path 38, from the trigger valve 17. In turn, the head valve 8 opens, the percussion piston 3 descends, and the nail driver 6 drives the nail into a member with its fore end.

Figure 11:
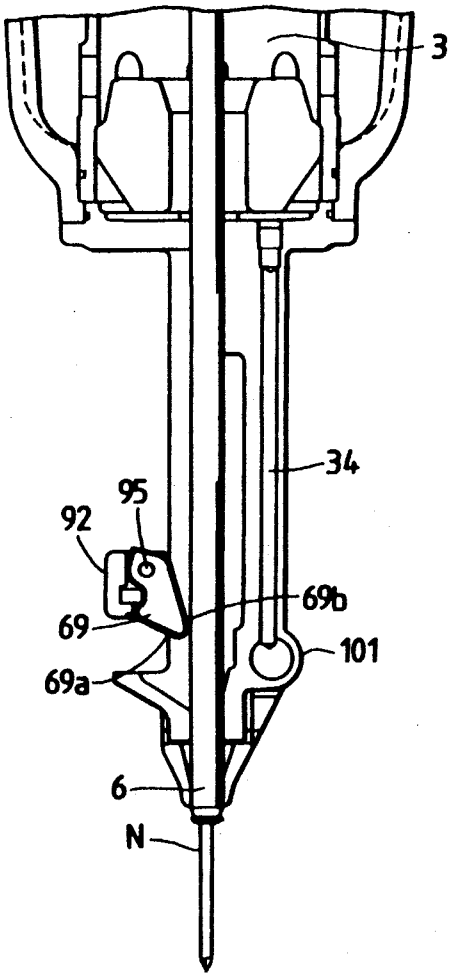
FIG. 11 is a sectional view, like that of FIG. 6, showing a state of the machine when the machine drives a nail by a nail driver.

During the course of ascending of the nail pusher 69 for return within the nail injection hole 4, the stop-contact face 69*b* engages the nail driver 6, and the contact face 69*a* thereof is turned about the pivot 95 in such a direction as to retract from the nail injection hole 4, as shown in FIG. 11.

When the trigger lever 51 is released, the trigger valve stem 32 moves from the top dead center to the bottom dead center, a compressed air signal representative of nail-drive end is generated, the through-holes 33 is closed to be isolated from the exhaust path 43, and at the same time it is connected to the main air chamber 7. Consequently, compressed air is supplied to the air paths 34 and 38, and the head valve 8 isolates the piston upper chamber 2*a* from the main air chamber 7, while opens it to the air (the atmosphere). The percussion piston 3 is returned up to the top dead center with the compressed air within the return air chamber 26. The nail push piston 67 is moved from the top dead center to the bottom dead center. During the movement of the piston, the nail pusher 69 separates the first nail of the nail band that is fed into the nail injection hole 4 of the nose 5 by a nail feeder 70, and pushes the separated nail till the nail chuck 35 grasps the body part of the nail. Thereafter, the paired lock pistons 106 and 107 in the piston cylinder mechanism 101 advance to lock the nail holders 99 and 100. For the next nail drive work, the nail is fixedly held by the nail holders 99 and 100, and the nail pusher 69 in a state that the nail is protruded from the nail chuck 35 by a fixed length.

Door Valve

As shown in FIGS. 1 and 2, a nail supply hole continuous to the nail injection hole 4 is formed in the nose 5 forming the nail injection hole 4. A nail supply guide 141 for guiding the nail band ranges from the magazine 64 to the nail injection hole 4. A nail supply mechanism 142 successively supplies the nail band along the nail supply guide 141 into the nail injection hole 4.

The nail supply guide 141 is made up of a fixed guide wall 141*a* integral with the nose 5, and a door 143 spaced from the fixed guide wall 141*a*. When the nail band is loaded into the magazine 64, the door 143 is opened. At this time, the innards of the door 143 are exposed to exterior.

As shown in FIG. 2, a door valve 165 operated in connection with the opening and closing operations of the door 143 is provided on the machine body 1. The door valve 165 includes a door valve stem 144 which is disposed at one end in the vicinity of the door 143 so as to come in contact with the door 143, a door valve cylinder 145 containing the door valve stem 144 slidable therein, and a valve spring 146 constantly urging the door valve stem 144 downwardly.

In a state that the door 143 is closed, the door valve stem 144 comes in contact with the door 143 and then the door valve 165 is moved upward, so that the air path 85 is communicatively connected to the air path 38 connecting to the trigger valve 17. When the door 143 is opened for loading the nail band, the door valve stem 144 disengages from the door 143. The valve spring 146 urges the valve stem to move downward, so that the air path 38 connecting to the air path 85 and the trigger valve 17 is shut off and the air path 85 is opened to the air (the atmosphere).

Specifically, when the door 143 is opened to load the nail band, the door valve stem 144 is moved downward by the valve spring 146, so that the air path 85 is opened to the air (the atmosphere) above the nail push piston 67 within the nail push cylinder 73 is discharged to the air (the atmosphere). The nail push piston 67 ascends for return, so that the nail pusher 69 retracts in the upper portion within the nail injection hole 4. Under this condition, the first nail of the nail band is loaded into the nose 5 and the door 143 is closed. Then, the door valve stem 144 contacts with the door 143 to be moved upward for return. Compressed air is introduced into the nail push cylinder 73 through the air path 85. With the compressed air, the nail push piston 67 is moved downward, so that the nail pusher 69 is inserted into the nail injection hole 4 of the nose 5, to separate the first nail from the nail band N to push it beyond the nail injection hole 4.

In connection with the nail loading operation, the nail push piston 67 is moved to the retracted position. Otherwise, one blank shot is required after the loading of nail, because the nail pusher 69 is positioned at the lower end position of the nail injection hole 4 of the nose 5 in a normal state, so that the first nail of the nail band cannot be loaded into the nose 5. Thus, it is possible to successively set the nails, first the first nail of the nail band, in the nail injection hole 4 after the nail is loaded.

Safety Device

As shown in FIGS. 1, 13, 14 and 15, the trigger valve 17 is operated by cooperation of the manually operated trigger lever 51 and a contact member 200 for detecting a nail-driven member which is disposed along the nail injection hole 4 of the nose 5.

The lower end of the contact member 200 serves as a detector 201 for detecting a nail-driven member W disposed around the nail injection hole 4 of the nose 5. The upper end 202 thereof is disposed in the vicinity of the trigger lever 51. The contact member 200 is supported by the nose 5 so that the detector 201 is movable along the axial direction of the nose 5 between a retracted position where the detector 201 is located above the lower end face of the nail injection hole 4 of the nose and a protruded position where the detector 201 is further protruded from the lower end face of the nail injection hole 4. Further, it is always urged toward the retracted position by means of a coiled spring 203 provided between it and the housing.

A swing lever 204 is disposed in parallel with the upper end 202 of the contact member 200. The swing lever 204 is supported by a shaft 205 in a manner that it is swingable about the shaft. A torsion coiled spring 206 constantly urges the top end 204*a* of the swing lever 204 to a position where it engages the operating part 210 (to be given later) of the trigger lever 51 (that is, the position where the lower end 204*b* of the swing lever engages the wall 207 of the contact member 200). The swing lever 204 is swung between the engaging position and a position where it departs from the operating pat 210.

A resilient member 208 is provided in association with the trigger lever 51. When the trigger lever 51 is turned, the resilient member 208 resiliently urges the contact member 200 to the protruded position while resisting the urging force by the coiled spring 203. The resilient member 208 is a torsion coiled spring of which one end is constantly in contact with the upper end 202 of the contact member 200. When the trigger lever 51 is operated to be turned, the contact member 200 is resiliently moved in the protruded direction through one or first end 209 of the resilient member 208.

The operating part 210 shaped like U and an operation part 211 shaped like a hook are provided in association with the trigger lever 51. The operating part 210 is rotatively supported by a shaft 212 which also rotatively supports the trigger lever 51. One end of the operating part serves as an operating terminal 213 to be brought in engagement with the upper end of the swing lever 204 of the contact member 200. The other end serves as a shoulder part 214 to be brought in engagement with the operation part 211. When the trigger lever 51 is not operated, the operating terminal 213 lies on the locus tracing the movement of the swing lever 204 of the contact member 200, and engages the top end 204*a* of the swing lever 204. When the contact member 200 is movable, the operating terminal retracts from the moving locus p of the swing lever 204 when the trigger lever 51 is turned. A locus tracing the movement of the operating part 210 from the position after it retracts from the moving locus of the swing lever 204, to the position where it engages the top end 204*a*, is set to be within the swing range of the swing lever 204.

The operation part 211 is rotatively supported by a shaft 215 of the trigger lever 51. One end of the operation part 211 shaped like a hook serves as an operating terminal 216 to be brought in engagement with the trigger valve stem 32 of the trigger valve 17, while the other end serves as an engaging face 217 to be brought in engagement with the shoulder part 214 of the operating part 210. The operation part 211 is urged by a spring 218 set on a shaft 215 so that its engaging face 217 is constantly brought into contact with the shoulder part 214 of the operating part 210. At the same time, the operating terminal 213 of the operating part 210 is also urged so as to be in contact with the swing lever 204 of the contact member 200.

Figure 13:
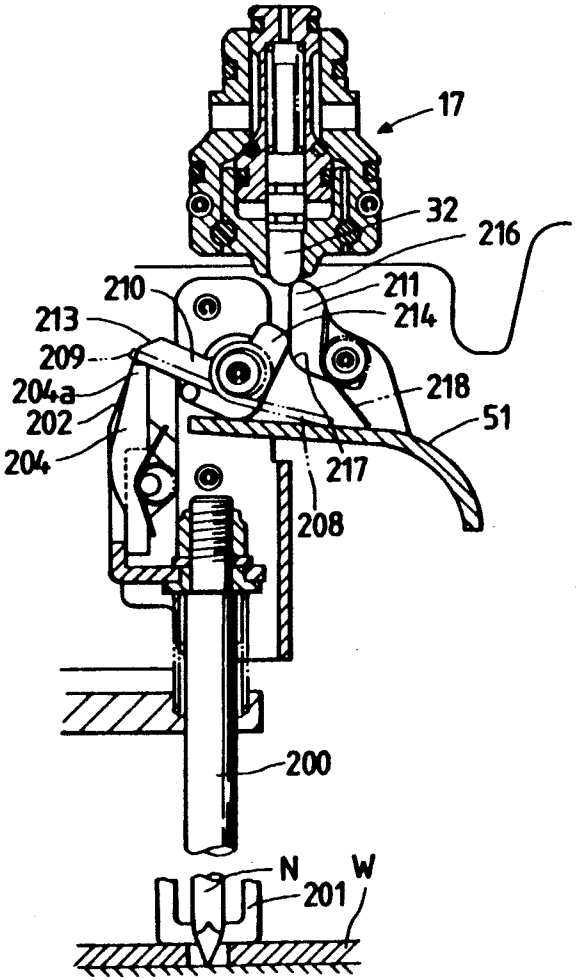
FIGS. 12 through 15 are diagrams showing various operation states of a safety device of the nailing machine.

The operation part 211 is associated with a locus altering means. With provision of the locus altering means, when the trigger lever 51 is turned about the shaft 212, the normal movement locus is altered at the time of starting the machine. The locus altering means is constructed with the combination of the shoulder part 214 of the operating part 210 and the engaging face 217 of the operation part 211. The position where the shoulder part 214 engages the engaging face 217 of the operation part 211 when the operating part 210 is turned is made different from that when it is not turned. With this, an angle of the operation part 211 to the trigger lever 51 is changed. As a result, the movement locus is altered to such a locus that when the trigger lever 51 is turned, the operating terminal 216 of the operation part 211 comes in contact with the trigger valve stem 32 of the trigger valve 17 or does not come in contact with them. To more specific, when the contact member 200 is movable in the protrusion direction, the operating part 210 is turned to move to the position to which it retracts from the movement locus of the swing lever 204. With the movement of the operating part, the operating terminal 216 of the operation part 211 moves so as to trace the locus not contacting with the trigger valve stem 32 of the trigger valve 17. Accordingly, the trigger valve 17 does not operate. On the other hand, as shown in FIG. 13, when the detector 201 contacts with the work W and the contact member 200 is inhibited from moving, the operating part 210 cannot be turned. The movement locus of the operating terminal 216 of the operation part 211 is altered so that it comes in contact with the trigger valve stem 32 of the trigger valve 17. Accordingly, the trigger valve 17 operates.

In the construction as mentioned above, as shown in FIG. 12, before the trigger lever 51 is operated, the contact member 200 is held at the upper portion in the figure, viz., at the retracted position by means of the coiled spring 203. In this state, the first end 209 of the resilient member 208 installed to the trigger lever 51 engages the fore edge of the trigger lever 51, and substantially it does not act on the contact member 200. Further in this state, the operating terminal 213 of the operating part 210 engages the top end 204*a* of the swing lever 204 of the contact member 200.

Then, the pointed end of the nail N is exactly positioned and the nail injection hole 4 of the nose 5 is pressed against the work W, and the trigger lever 51 is operated to turn. In turn, the upper end 202 of the contact member 200 is pressed down in the drawing with the first end 209 of the resilient member 208 mounted to the trigger lever 51, so that the contact member 200 is pressed so as to move in the protrusion direction. However, its movement in the protrusion direction is checked since the detector 201 of the contact member 200 contacts with the work W. Accordingly, it is stopped while first end 209 of the resilient member 208 is in contact with the upper end 202 of the contact member, and with progression of the turning operation of the trigger lever 51, the resilient member 208 is deformed.

As the result of checking the movement of the contact member 200 is the protrusion direction, the turning of it is prevented in a state that the operating terminal 213 of the operating part 210 engages the swing lever 204 of the contact member 200. With this, the cooperation of the shoulder part 214 of the operating part 210 and the engaging face 217 of the operation part 211 alters the movement locus of the operating terminal 216 of the operation part 211. The operating terminal 216 comes in contact with the trigger valve stem 32 of the trigger valve 17 to operate it to start up the nailing machine.

When the trigger lever 51 is turned in a state that the work W is not disposed in the front of the nail injection hole 4 of the nose 5, the contact member 200 moves up to the protrusion position through the first end 209 of the resilient member 208, with the turning operation of the trigger lever 51. The operating terminal 213 of the operating part 210 engages the swing lever 204 of the contact member 200 at the beginning of the turning operation. With progress of the turning, it gradually disengages from the swing lever 204, and it turns together with the trigger level 51. When the turning operation of the trigger lever 51 approaches to its termination, the operating terminal 213 of the operating part 210 is located at the position to which it retracts from the movement locus of the swing lever 204. Therefore, if the trigger lever 51 is turned, the movement locus of the operating terminal 216 of the operation part 211 is not altered. Then, the operating terminal 216 does not engage the trigger valve stem 32 of the trigger valve 17, and the nailing machine is not started up.

Figure 15:
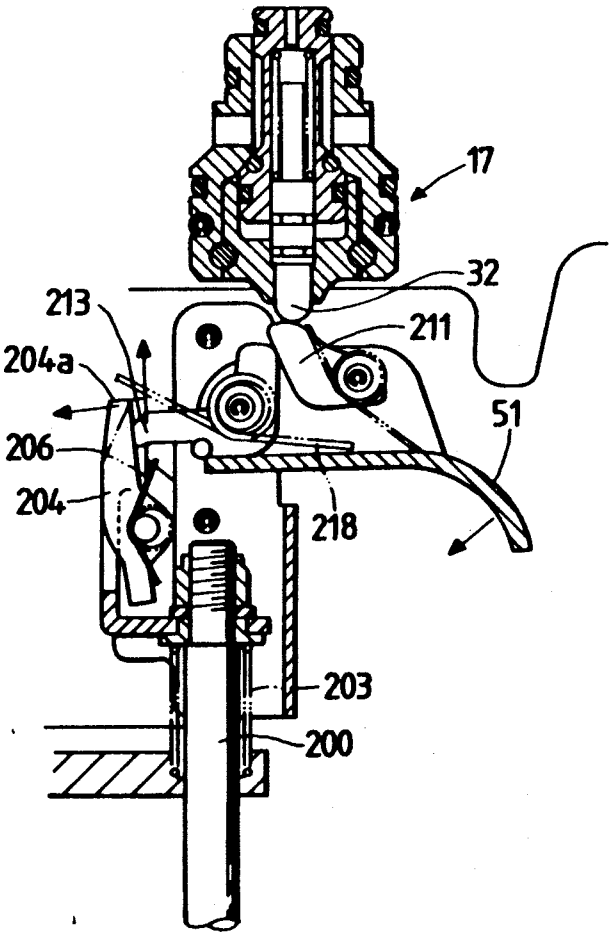
Figure 14:
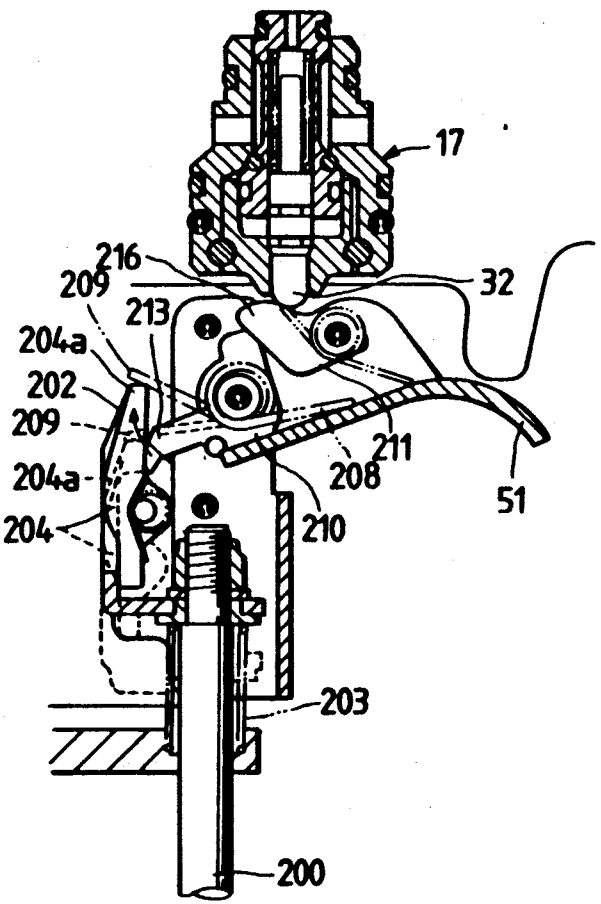

In the above state, the detector 201 of the contact member 200 is protruded below the bottom face of the nose 5. If it is carelessly pressed against the work W, the contact member 200 moves and its upper end 202 presses the first end 209 of the resilient member 208 to deform it. However, the operating part 210 does not operate since its operating terminal 213 has been retracted from the movement locus of the contact member 200. The operation part 211 also does not operate the trigger valve 17 (seen the solid line in the figure). Therefore, the pneumatic nailing machine will never be started up in the situation under discussion. In this case, as shown in FIG. 15, the trigger lever 51 is released to turn the resilient member 208 in the reverse direction. Then, the operating terminal 213 of the operating part 210 moves from the retracted position to the position where it engages the top end 204*a*. Its movement locus is within the swing range of the swing lever 204. Under this condition, the operating part 210, during the course of its movement, pushes the swing lever 204 in such a direction that it disengages from the operating terminal 213 and the lever is swung so. The operating part 210 departs from the swing lever 204, and then engages the top end 204*a* to be placed in the initial state. Further, the trigger lever 51 is turned again while the nose 5 is pushed against the work W. At this time, the contact member 200 remains stopped. Accordingly, the movement locus of the operating terminal 216 of the operation part 211 is altered again. The operating terminal 216 engages the trigger valve stem 32 of the trigger valve 17, to operate it. And the pneumatic nailing machine starts up.

As described above, the safety device of the pneumatic nailing machine according to the present invention can reliably prevent the machine from starting up even when the contact member is operated after the trigger lever is operated. Accordingly, in such a situation, for example, that an operator moves to another work place while taking the machine of which the trigger lever is left operated, and the nose of the machine contacts another worker, the machine will never be started up to inject the nail toward the worker. In this respect, the safety device of the invention provides a high degree of safety.

Further, in a state that the trigger lever is left operated and the bottom of the nose is pushed against the work, the nail can be driven into the work by merely operating the trigger lever again, without moving the nailing machine. Even after the mistaken operation, it can be operated again without another positioning work for nailing. In this respect, the nailing efficiency is improved remarkably.

While the present invention has been described above with respect to two preferred embodiments thereof, it should of course be understood that the present invention should not be limited only to these embodiments but various changes or modifications may be made without departure from the scope of the present invention as defined by the appended claims.

What is claimed is:

1. A nailing machine comprising:

a housing defining the contour of a nailing machine body;

a percussion cylinder disposed within the housing;

a percussion piston slidably disposed within the percussion cylinder and integrally coupled with a percussion driver for driving nails;

a nose member provided at one end of the housing, said nose member having a nail injection hole for slidably guiding the percussion driver;

nail supply means, supported by the nose member, for successively supplying connected nails to the nail injection hole through an opening formed in the side wall of the nail injection hole;

a main chamber provided within the housing and coupled with an air supply source;

a main valve, disposed at the upper end of the percussion cylinder, for introducing compressed air in the main chamber into the percussion cylinder or for discharging compressed air in the percussion cylinder to the air;

a trigger valve, manually operable, for supplying to the main valve an operation signal to operate the main valve;

nail protruding means for separating a nail from said connected nails supplied to the nail injection hole of the nose member by the nail supply means before the nail is driven by the percussion driver, and for pushing the nail to the front of the nail injection hole; and nail holding means for holding the body part of the nail pushed to the fore side of the nose member by the nail push means in a state that the pointed end of the nail is protruded.

2. The nailing mechanism according to claim 1, wherein said nail protruding means comprises:

a nail push member movable along the axis of the nail injection hole of the nose member, said nail push member advancing to and retracting from said nail injection hole through slits formed in the side wall of said nail injection hole;

a piston cylinder mechanism having a piston, which is operable interlocking with the nail pusher in order to move the nail push member along the nail injection hole of the nose member;

wherein the piston cylinder mechanism is normally located at the nail protrusion position, the piston is operated in response to a nail drive instruction of the nailing machine, thereby to retract the nail push member, and after the nail is driven, the piston is operated in the operation direction to cause the nail push member to protrude the nail from the nose member, whereby the nail is held thereat.

3. The nailing machine according to claim 2 further including a nail protrusion length adjusting mechanism which is arranged such that the piston cylinder mechanism of the nail protruding means includes a piston stop member, disposed under the cylinder, for determining the bottom dead center of the piston when it engages the bottom face of the piston, the piston member being held in the cylinder in a manner that the position of the piston member is adjustable in the longitudinal direction along the movement direction of the piston.

4. The nailing mechanism according to claim 1, wherein said nail holding means includes a pair of chuck mechanism supported at the nose member in a manner that the chuck mechanisms are rotatable in the axial lines orthogonal to the axis of the nail injection hole, whereby in a normal state, the chuck mechanisms nip the body part of the nail protruded from the foremost end of the nail injection hole by the nail protruding means, thereby preventing the nail from dropping out of the nail injection hole.

5. The nailing mechanism according to claim 4, wherein said nail holding means is arranged such that a lock cylinder is disposed between the operation means of the nail chuck mechanisms, the piston rod of the lock piston contained in the lock cylinder is disposed in opposition to the operation means, a main valve operating signal is supplied from the trigger valve to both the lock pistons of the lock cylinder.

6. The nailing machine according to the claim 1, further comprising a door valve which includes a door supported by the nose member so as to allow connected nails to be loaded into the nail supply mechanism, the door valve being operated when the door is opened, wherein the door valve is disposed in the air path connecting the piston cylinder mechanism to the drive valve, and the air in the air path is controlled so that the piston cylinder mechanism is operated by opening the door, whereby the nail push member is moved to the retracted position, and the nail push member is moved to the nail protrusion position again by closing the door.

7. The nailing machine according to the claim 1 further including a safety mechanism comprising:

a trigger lever, manually operable, for operating the trigger valve;

a contact member being slidably held by the nose member in a manner that the contact member is slidable along the axis of the nail injection hole of the nose member, the first end of the contact member being disposed in the vicinity of the trigger lever and the second end of the contact member serving as a contact portion to be brought in contact with a member to be nailed;

spring means for constantly urging the contact member to be located at the position to which the contact portion retracts;

operation member rotatively supported by the trigger lever, cooperating with the upper end of the contact member to allow the trigger lever, when operated, to operate the trigger valve when the contact member is not operated; and a spring member carried on the trigger lever, engaging the first end of the contact member when the trigger lever is turned, whereby moving the contact member in the protrusion direction.

8. The nailing mechanism according to claim 7, wherein said safety device further includes a swing lever to be brought in engagement with the operation member, the swing lever is located on the upper part of the contact member, the locus of the foremost end of the operation member, when the trigger lever is turned, is depicted such that it is swung up to the position where it departs from the swing lever, and the swing lever is supported in a manner that it is rotative in the retraction direction so as not to interrupt the turn of the operation member in the return direction, and further is resiliently urged.

* * * * *